US005144936A

United States Patent [19]

Murata et al.

[11] Patent Number: 5,144,936

[45] Date of Patent: Sep. 8, 1992

[54] IGNITION APPARATUS FOR INTERNAL COMBUSTION ENGINE

[75] Inventors: Shigemi Murata; Masayuki Ikeuchi, both of Himeji, Japan

[73] Assignee: Mitsubishi Denki Kabushiki Kaisha, Tokyo, Japan

[21] Appl. No.: 764,594

[22] Filed: Sep. 24, 1991

[30] Foreign Application Priority Data

Sep. 27, 1990 [JP] Japan ..... 2-255140
Oct. 2, 1990 [JP] Japan ..... 2-263046
Oct. 11, 1990 [JP] Japan ..... 2-270617

[51] Int. Cl.[5] ..... F02P 7/06; F02P 3/055

[52] U.S. Cl. ..... 123/655; 123/630; 123/169 PA; 123/634; 439/125

[58] Field of Search ..... 123/146.5 A, 416, 418, 123/425, 630, 634, 644, 647, 655, 656, 169 PA; 324/388, 399; 439/125, 126

[56] References Cited

U.S. PATENT DOCUMENTS 4,041,922 8/1977 Abe et al. ..... 123/655 X
4,083,347 4/1978 Grather et al. ..... 123/655 X
4,308,488 12/1981 Imai et al. ..... 123/655 X
4,327,702 5/1982 Imai et al. ..... 123/655 X
4,357,927 11/1982 Igashira et al. ..... 123/655 X
4,392,473 7/1983 Tsutsui et al. ..... 123/655 X
4,463,744 8/1984 Tanaka et al. ..... 123/634 X
4,915,086 4/1990 Ciliberto et al. ..... 123/644 X

FOREIGN PATENT DOCUMENTS 133641 10/1981 Japan .
16260 1/1982 Japan ..... 123/655
38380 3/1983 Japan ..... 123/655

*Primary Examiner*—Willis R. Wolfe
*Attorney, Agent, or Firm*—Sughrue, Mion, Zinn, Macpeak and Seas

[57] ABSTRACT

An ignition apparatus for internal combustion engines of which configuration is simplified to reduce production cost and improve reliability of the apparatus. The present invention with the above object can be completed in three main embodiments. The ignition apparatus according to one embodiment of the present invention has a distributor cap. The distributor cap comprises an ignition coil; a central electrode connected to the ignition coil; a plurality of side electrodes each connected to an ignition plug of each cylinder of the engine and selectively connected to the central electrode; a plurality of diodes each connected to the plurality of side electrodes each; a terminal connected to the diodes for outputting ion detecting signals; and a resin portion for holding the central electrode, the plurality of side electrodes, the plurality of diodes, and the terminal. In the above embodiment, the ion current detecting diodes are built in the distributor cap to remove the diode assemblies each provided to each cylinder of the engine, resulting in the decreased number of parts for the apparatus.

3 Claims, 8 Drawing Sheets

IGNITION APPARATUS FOR INTERNAL COMBUSTION ENGINE

BACKGROUND OF THE INVENTION

1. Field of the Invention

The present invention relates to an ignition apparatus for internal combustion engines and in particular to an ignition apparatus of which configuration is simplified to reduce the number of parts of the apparatus.

2. Description of the Prior Art

FIG. 5 shows a configuration of a conventional ignition apparatus for internal combustion engines. In the figure, denoted 1 is a distributor cap, 2 a central electrode disposed at the center of the distributor cap 1, 3 a plurality of side electrodes each disposed at a circumference of the distributor cap 1 in accordance with each cylinder of the engine, 4 a distribution rotor rotatably slidably contacting with the central electrode 2 and selectively connected to the side electrode 3, 5 a high-voltage code connected to the side electrode 3, 6 ion current detecting diodes, 7 a diode assembly including the diodes 6. The diode assembly 7 comprises a diode and resin portion enclosing electrodes and is disposed in accordance with each cylinder of the engine. Reference numeral 8 shows an ignition plug connected to the side electrode 3 by way of the high-voltage code 5 and the diode assembly 7, 9 an engine on which the ignition plug is mounted, 10 a signal generator for detecting a rotation angle of the engine 9, 11 an ion current detecting unit connected to the ion current detecting diodes 6, 12 an ion current flowing route, 13 a computer unit for controlling ignition timing or the like based on output signals from the ion current detecting unit 11. Denoted 14 is a power transistor controlled in accordance with output signals from the computer unit 13. Further, numeral 15 shows an ignition coil of which primary and secondary windings are connected to a collector of the power transistor and the central electrode respectively.

Now, operation of the conventional ignition apparatus for internal combustion engines shown in FIG. 5 will be explained. The computer unit 13 is operated synchronously with the rotation of the internal combustion engine, that is, in response to output signals from the signal generator 10. When an output signal from the computer unit turns off the power transistor, counter electromotive force is generated at the primary winding of the ignition coil 15 to generate negative high voltage. Then, the negative high voltage is applied to the ignition plug by way of the central electrode 2, the side electrode 3, the high-voltage code 5 and the like to ignite the plug 8. In this case, the negative high voltage has no effect on the ion current detecting unit 11 due to the direction of the diode 6. When mixed gas in the cylinder of the engine is burnt after ignition of the ignition plug 6, ion current is generated to be inputted to the ion current detecting unit 11 through an ion current flowing route 12 because the ion current is biased to negative voltage by negative power source of the ion current detecting unit 11. Whether or not the mixed gas is normally burnt in each cylinder of the engine is known by the computer unit through signals transmitted from the ion current detecting unit 11 and rotation angle of the internal combustion engine detected by the signal generator 10.

Since the conventional ignition apparatus for internal combustion engines with a configuration described above is provided with the diode assembly for each cylinder of the engine, production cost of the apparatus increases due to a complicated structure thereof and the layout for the diode assembly becomes difficult due to small engine room adopted in recent years. Moreover, there is another problem that the increased number of parts of the apparatus may decrease reliability of the apparatus.

FIG. 7 shows another embodiment of an ignition apparatus for internal combustion engines conventionally used. In the figure, reference numeral 301 shows an ignition plug and 302 is a connection device including an ion current detecting diode 303. Negative side of the ignition plug 301 is grounded. Further, the other side of the plug is connected to an external connection terminal 305 of an ignition coil unit 304 by way of the connection device 302 and is also connected to negative electrode of a dc power source 307 by way of the ion current detecting diode 303 of the connection device 302 and a resistor 305. A cathode of the ion current detecting diode 303 is grounded through a condenser 308 and a resistor 309. Further, between the condenser 308 and the resistor 309 is provided a terminal 310 to output ion current detecting signals.

The ignition coil unit, which is made of high-voltage material to resist high voltage, includes an ignition coil 311 and a backflow protection diode 312. The ignition coil 311 is connected to a power source by way of a positive terminal 313 at an end of primary winding thereof. Further, the other end of the primary winding of the coil is connected to a collector of the power transistor 315 by way of a negative terminal. An emitter of the power transistor is grounded and a base thereof is connected to an input terminal 316 to which control signals from a control unit (not shown) for controlling fuel injection timing and ignition timing are inputted.

The operation of the conventional ignition apparatus for internal combustion engines shown in FIG. 7 is almost the same as the apparatus shown in FIG. 6, therefore, explanation of the operation is omitted.

Since the conventional ignition apparatus for internal combustion engines shown in FIG. 7 with a configuration described above is separately provided with high-voltage connection device 302 including the ion current detecting diode 303, production cost of the apparatus increases due to a complicated structure thereof and a complicated layout for high-voltage cables.

FIG. 8 shows a configuration of a conventional ignition plug connecting apparatus used for ignition apparatus for internal combustion engines. In the figure, denoted 201 is an ignition plug, 202 a high-voltage code, 203 a connecting member for the ignition plug 201 and the high-voltage code 202, 204 a backflow protection diode, 205 an ion current detecting diode. These diodes 204 and 205 are provided with anodes **204*a* and 205*a*, and cathodes 204*b* and 205*b* respectively. Numeral 206 shows a conductive member connected to the anodes 204*a* and 205*a*. Further, denoted 207 is a connection member for connecting the conductive member 206 and the high-voltage code 202, 208 a housing accommodating the diode 204 and the conductive member 206, 209 a high-voltage code, 210 a connection member for the high-voltage code and the cathode 204*b*, 211 another connection member for connecting the high-voltage code 209 to a distributor (not shown), and 212 an output signal cable for connecting the cathode 205*b*** to an ion current detecting apparatus (not shown).

Negative high voltage, which is generated at an ignition coil (not shown) connected to the connection member 211 on the distributor side thereof, is applied by way of the diode 204 to the ignition plug 201, thereby fuel gas is ignited. Then, ion current generated by the combustion of the fuel gas is fed to the ion current detecting apparatus by way of the diode 205 to check flameout.

Since the conventional ignition plug connecting apparatus engines has a configuration described above, production cost of the apparatus increases due to the increased number of parts of the apparatus.

Further, wiring for high-voltage codes 202 and 209 is troublesome, especially when the number of cylinders is increased. There is another problem that noise caused by high voltage for ignition is likely to put on a signal line since the high-voltage code 202 is commonly used for the high-voltage ignition and the signal line.

SUMMARY OF THE INVENTION

The present invention overcomes these problems noted above with respect to the prior art. It is an object of the present invention to provide an ignition apparatus of which structure is simplified to reduce production cost and improve reliability of the apparatus.

The present invention with the above object can be complete in three main embodiments, the detailed description of each being explained below.

An ignition apparatus for internal combustion engines according to a first embodiment of the present invention has a distributor cap. The distributor cap comprises an ignition coil; a central electrode connected to the ignition coil; a plurality of side electrodes each connected to an ignition plug of each cylinder of the engine and selectively connected to the central electrode; a plurality of diodes each connected to the plurality of side electrodes each; a terminal connected to the diodes for outputting ion detecting signals; and a resin portion for holding the central electrode, the plurality of side electrodes, the plurality of diodes, and the terminal.

In the above embodiment, the ion current detecting diodes are built in the distributor cap to remove the diode assemblies each provided to each cylinder of the engine, resulting in the decreased number of parts for the apparatus.

An ignition apparatus for internal combustion engines according to a second embodiment of the present invention comprises an ignition coil; and an ignition coil unit having an ion current backflow protection diode and an ion current detecting diode, the ion current backflow protection diode connected to a secondary winding of the ignition coil, the ion current detecting diode denoted in a branch line of the ion current backflow protection diode and built in the coil unit.

In the embodiment described above, the ion detecting diode is built in the ignition coil unit to miniaturize the apparatus.

An ignition apparatus for internal combustion engines according to a third embodiment of the present invention has an ignition plug connection apparatus. The ignition plug connection apparatus comprises a conductive member mounted on a head of an ignition plug; a plurality of diodes of which anodes are connected to the conductive member; a frame fixing the conductive member and the diodes.

According to the above configuration, production cost of the apparatus and the reliability of the apparatus is improved. Further, noise caused by high voltage for ignition has no effect on a signal line because of considerable decrease in commonly used line for the high-voltage and the signals.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
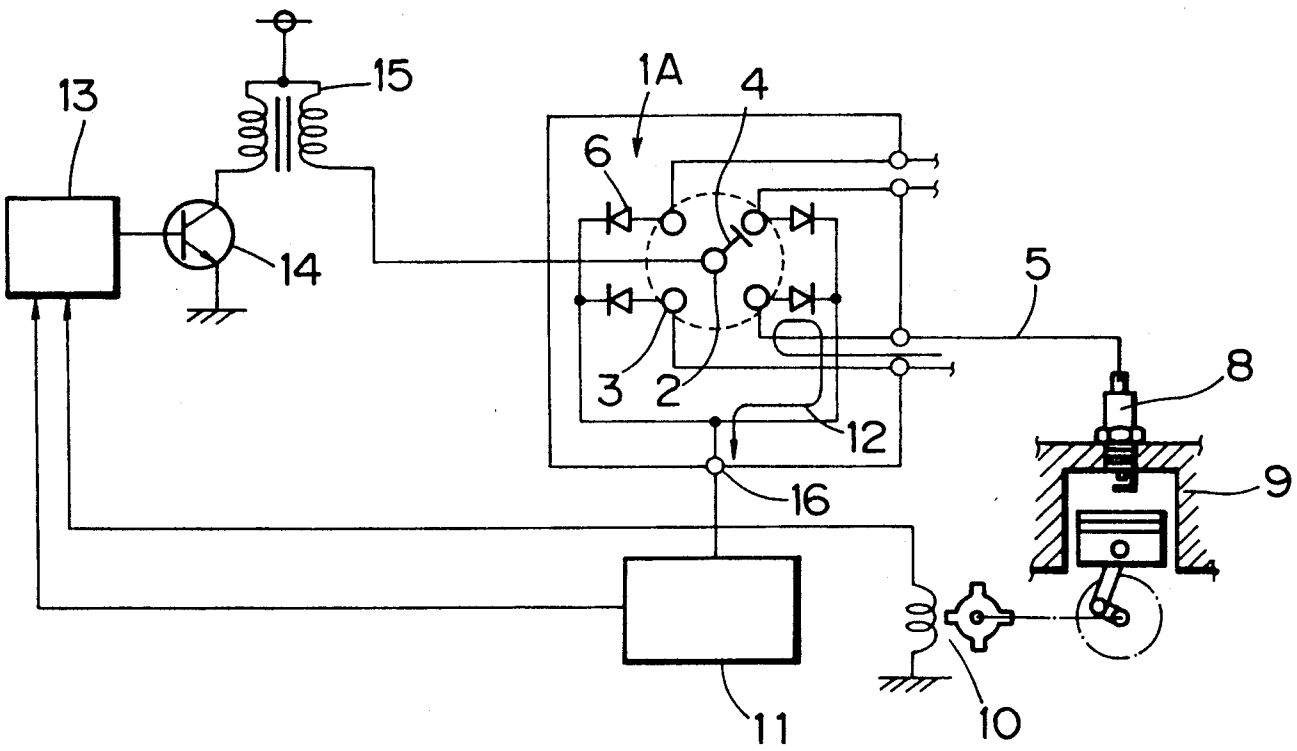
FIG. 1 shows an ignition apparatus for internal combustion engines according to a first embodiment of the present invention.
Figure 5:
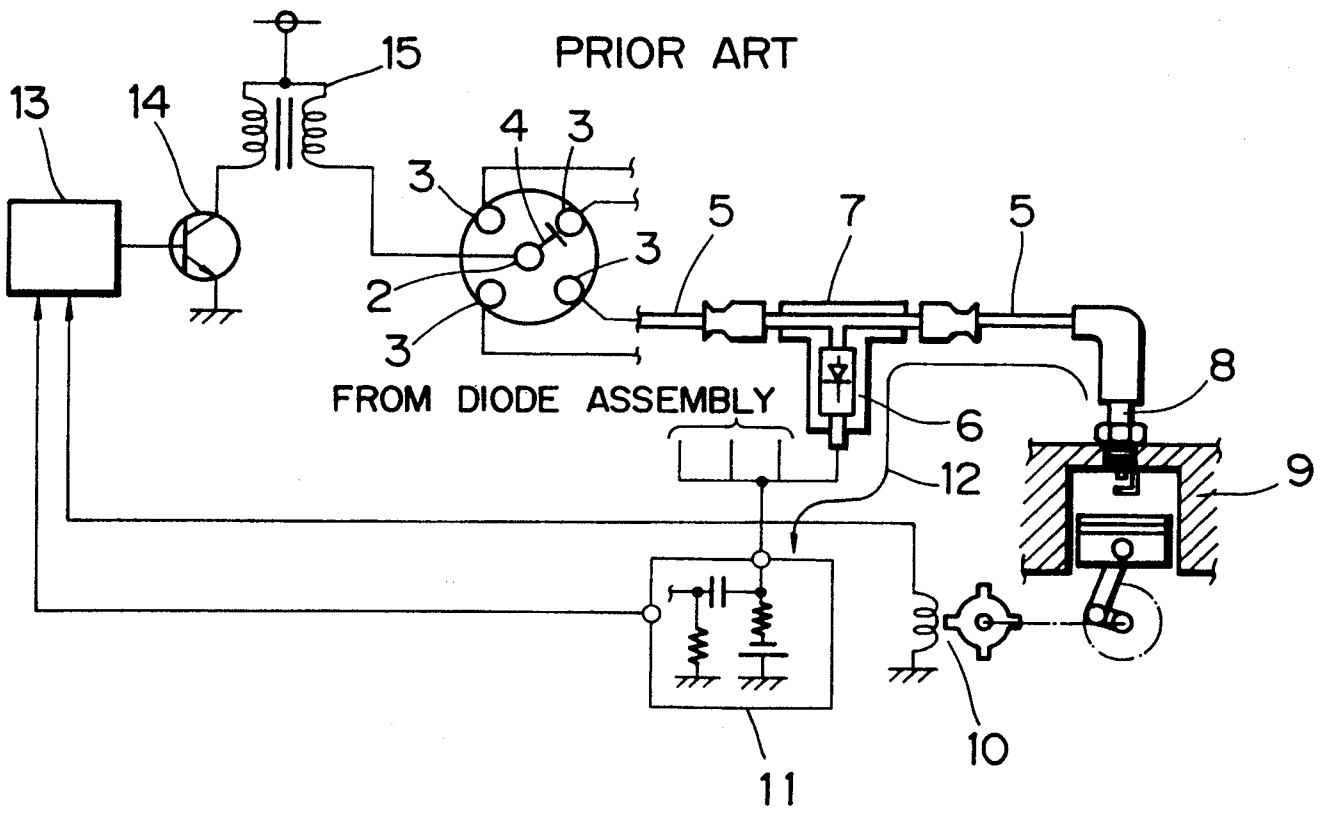
FIG. 5 PRIOR ART
FIG. 5 is a conventional ignition apparatus for internal combustion engines.

Now, an ignition apparatus according to a first embodiment of the present invention will be explained with reference to drawings. FIG. 1 illustrates a configuration of the ignition apparatus according to the first embodiment. In the figure, apparatus or portions similar to those of FIG. 5 are described with the same symbols. In this embodiment, ion current detecting diodes 6 each, which is disposed in accordance with each cylinder of the engine, is built in a distributor cap 1A. Accordingly, as an example, four diodes 6 are built in the distributor cap 1A since four side electrodes are applied for four-cylinder engine. An anode of the diodes 6 each is connected to corresponding side electrode 3 and cathodes thereof are connected to each other to be connected to an output terminal 16. Further, the terminal 16 is connected to an ion current detecting unit 11. Therefore, the diode assembly 7 conventionally used is unnecessary in this embodiment.

Next, operation of the ignition apparatus according to the first embodiment will be explained. A power transistor 14 is controlled synchronously with the rotation of an internal combustion engine by a computer unit 13, that is, in response to output signals from a signal generator 10. When the power transistor is turned off by the computer unit, counter electromotive force is generated at the primary winding of the ignition coil 15 to generate negative high voltage in accordance with the counter electromotive force. Then, the negative high voltage is applied to the ignition plug by way of a central electrode 2, side electrodes 3, a high-voltage code 5 and the like to ignite the plug 8. In this case, the negative high voltage has no effect on the ion current detecting unit 11 due to the direction of the diode 6. When mixed gas in the cylinder of the engine is burnt after ignition of the ignition plug 6, ion current is generated to be inputted to the ion current detecting unit 11 through an ion current flowing route 12 (only for lower-left diode is described in the figure) because the ion current is biased to negative voltage by negative power source of the ion current detecting unit 11. Whether or not the mixed gas is normally burnt in each cylinder of the engine is known by the computer unit through the signal transmitted from the ion current detecting unit 11 and rotation angle of the internal combustion engine detected by the signal generator 10.

Figure 2:
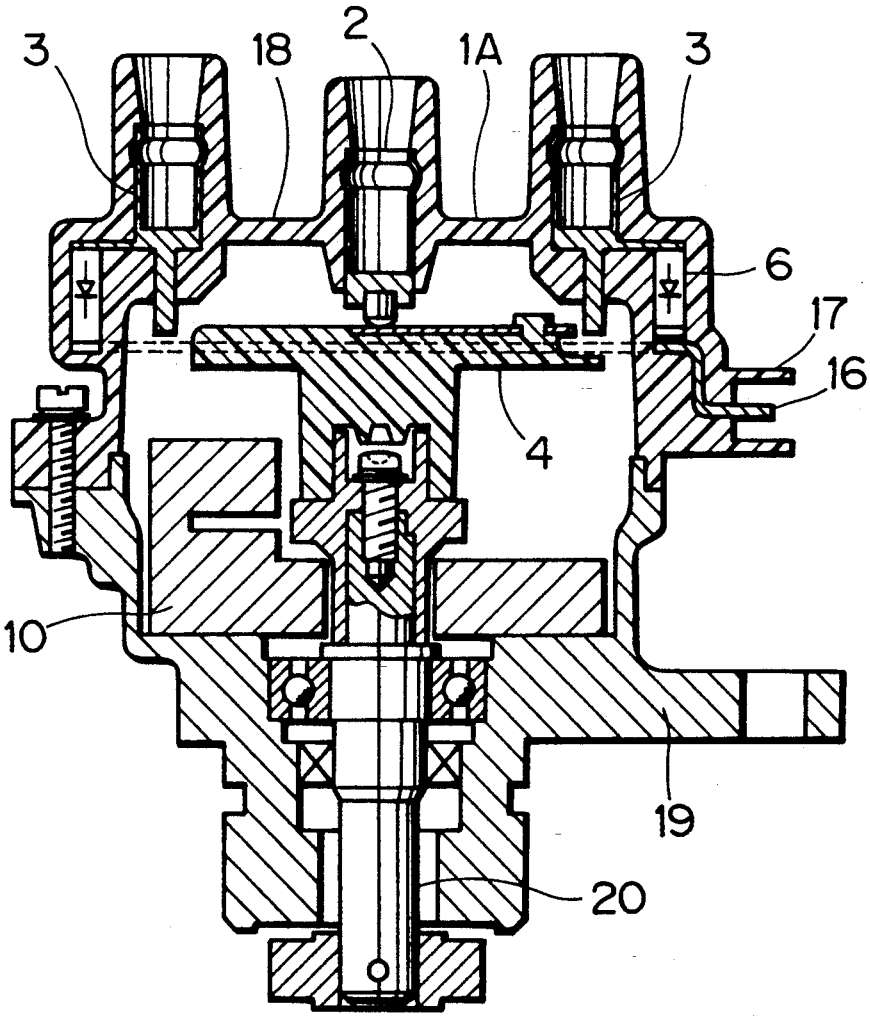
FIG. 2 shows a primary portion of the ignition apparatus described in FIG. 1.

FIG. 2 shows an embodiment of structure of the ignition apparatus for internal combustion engines shown in FIG. 1. In the figure, portions corresponding to those of FIG. 1 are described with the same symbols. Reference numeral 17 is a connector having the terminal 16, which is to be connected to external equipment. Denoted 18 is a resin portion for supporting the central electrode 2, the side electrodes 3, the diodes 6, and the terminal 16. Further, 19 is a distributor housing which is engaged with the distributor cap 1A and is fixed with machine screws. Denoted 20 is a shaft rotating synchronously with the rotation angle of the angle of the engine shown in FIG. 1 and the rotation of the engine is detected by the signal generator 10. A distribution rotor 4 attached at one end of the shaft 20 distributes negative high voltage for ignition, which is inputted to the central electrode 2, to prescribed side electrode of the cylinder of the engine.

Figure 3:
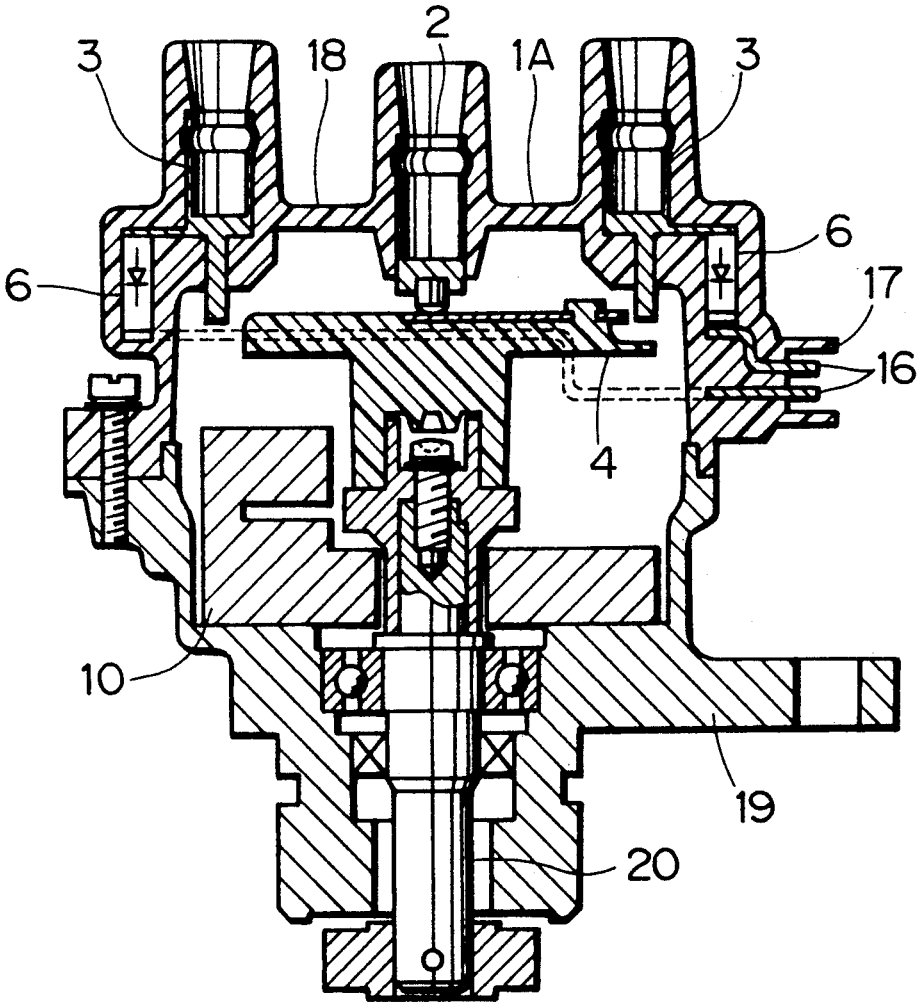
FIG. 3 shows another example of a primary portion of the ignition apparatus according to the first embodiment of the present invention.

FIG. 3 shows another example of the structure of the ignition apparatus according to the present invention. In the figure, portions corresponding to those of FIG. 2 are described with the same symbols. In the ignition apparatus shown in FIG. 2, the cathodes of the diodes 6 are commonly connected to one output terminal 13. On the other hand, the ignition apparatus shown in FIG. 3 is provided with the output terminal 13 corresponding to each of the diodes 6.

Since the ignition apparatus for internal combustion engines according to the first embodiment of the present invention comprises: an ignition coil which is connected to a central electrode; side electrodes each connected to an ignition plug of a cylinder of the engine and is selectively connected to the central electrode; a diode connected to the side electrodes each; a terminal connected to the diode for extracting an ion current signal; and a distributor cap made of resin material for supporting the central electrode, the side electrodes, the diodes, and the terminal, production cost of the ignition apparatus is decreased and reliability thereof is increased due to the decreased number of parts and simple structure.

Figure 4:
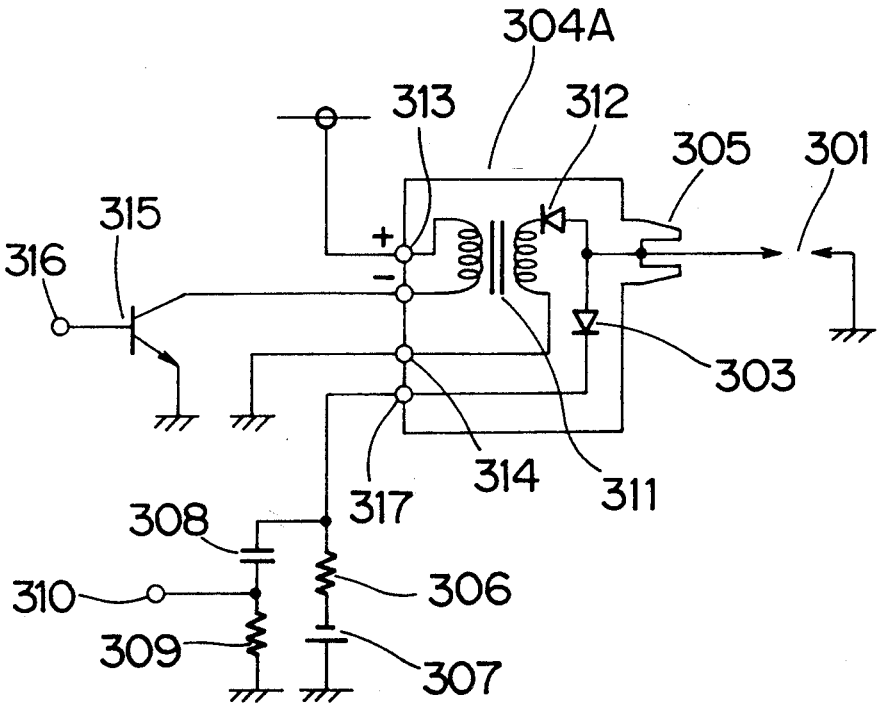
FIG. 4 is an ignition apparatus for internal combustion engines according to a second embodiment of the present invention.
Figure 7:
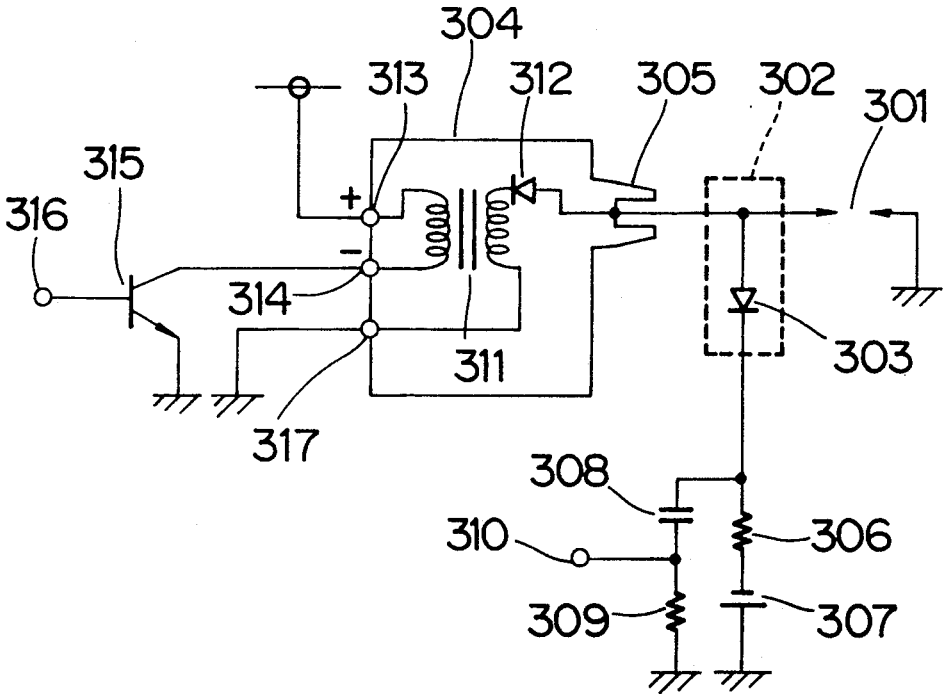
FIG. 7 PRIOR ART
FIG. 7 is another conventional ignition apparatus for internal combustion engines.

Next, an ignition apparatus according to a second embodiment will be explained. FIG. 4 shows a configuration of the apparatus according to the second embodiment. In the figure, numerals 301, 302, and 305 from 316 describe device or portions similar to those of FIG. 7. In this embodiment, however, an ignition coil unit 304A is used in place of the ignition unit 314 shown in FIG. 7. This ignition coil unit 304A is made of the same materials as that of FIG. 7 to stand high voltage and includes an ion current detecting diode 303 as well as an ignition coil and an ion current backflow protection diode 312. Anodes of the ion current detecting diode 303 and the ion current backflow protection diode 312 are connected each other at the external connection terminal 305 and then the anode of the ion current detecting diode 303 is connected to an output terminal 317 which is connected to a resistor 306 and a condenser 308. The external connection terminal 305 is directly connected to the negative side of the ignition plug 301.

Next, operation of the ignition apparatus for internal combustion engines according to the second embodiment described in FIG. 4 will be explained. A power transistor 315 is controlled synchronously with the rotation of an internal combustion engine by a control unit for controlling fuel injection timing and ignition timing. When the power transistor is turned off by the control unit, counter electromotive force is generated at a primary winding of the ignition coil 311 to generate negative high voltage. Then, in accordance with the counter electromotive force, at a secondary winding of the ignition coil 311 is generated negative high voltage, which is fed to the ignition plug 301 by way of the diode 312 to ignite the ignition plug. Mixed gas is burnt in cylinders of the engine after ignition of the ignition plug 301 to generate ion current to be detected at the output terminal 310 by way of the ion current detecting diode 303.

As described above, in the ignition apparatus for internal combustion engines according to the second embodiment, the ion current detecting diode denoted in a branch line of the ion current backflow protection diode is built in the ignition coil unit, resulting in not only simple structure of the apparatus but also simple layout of the high-voltage cables, which decreases production cost of the apparatus.

Figure 6:
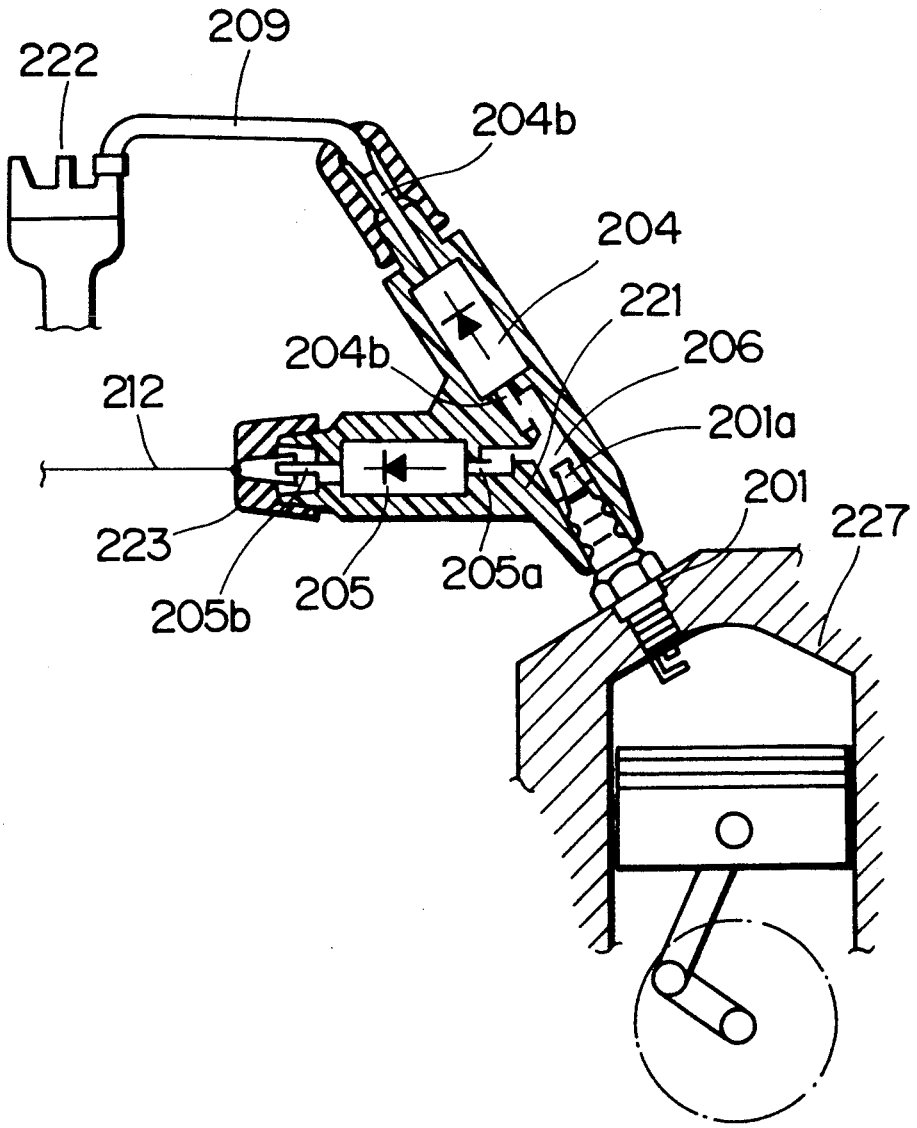
FIG. 6 is an ignition plug connecting apparatus according to one embodiment of the present invention.
Figure 8:
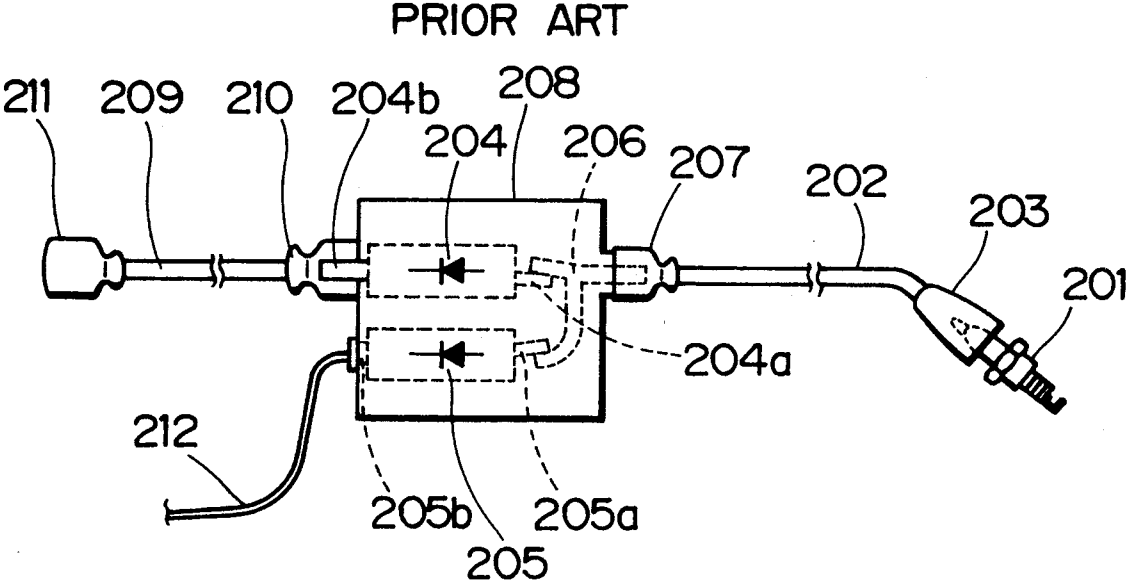
FIG. 8 PRIOR ART
FIG. 8 is a conventional ignition plug connecting apparatus.

FIG. 6 shows an ignition plug connection apparatus which is used for an ignition apparatus for internal combustion engines according to a third embodiment of the present invention. In the figure, reference numerals 201, 204 to 206, 209, and 212 describe device or portions similar to those of FIG. 8. In this embodiment, on a head **201*a* of an ignition plug 201 is mounted a conductive member 206. Then, diodes 204 and 205, and the conductive member 206 are fixed together by a frame 221 as described in FIG. 6. A cathode 204*b* of the diode 204 is connected to a distributor 222 by way of a high-voltage code. Further, a cathode 205*b* of the diode 205 is connected to an output signal line 212 by way of a connector 223**. A rear end of the ignition plug projects into a cylinder of an engine.

Next, operation of the ignition plug connection apparatus according to the third embodiment of the present invention will be explained. Negative high voltage generated at an ignition coil (not shown) on the distributor side is fed to the ignition plug 201 by way of the diode to ignite the ignition plug. As a result, mixed gas is burnt by the ignition to generate ion current, which is inputted to an ion current detecting device (not shown) to check flameout.

Since the ignition apparatus for internal combustion engines described above is provided with a conductive member mounted on the head of the ignition plug, diodes of which anodes are connected to the conductive member, and the frame fixing the conductive member and the diodes, the number of parts used for the ignition apparatus is decreased to simplify the structure, to reduce production cost, and to improve the reliability of the ignition apparatus. Further, portions commonly used for a high-voltage line for ignition and a signal line are considerably decreased so that noise caused by the high voltage for ignition have no effect on the signal line.

What is claimed is:

1. An ignition apparatus for internal combustion engines having a distributor cap, said distributor cap comprising:

an ignition coil;

a central electrode connected to said ignition coil;

a plurality of side electrodes each connected to an ignition plug of each cylinder of the engine and selectively connected to said central electrode;

a plurality of diodes each connected to said plurality of side electrodes each;

a terminal connected to said diodes for outputting ion detecting signals; and a resin portion for holding said central electrode, said plurality of side electrodes, said plurality of diodes, and said terminal.

2. An ignition apparatus for internal combustion engines comprising:

an ignition coil; and an ignition coil unit having an ion current backflow protection diode and an ion current detecting diode, said ion current backflow protection diode connected to a secondary winding of said ignition coil and built in said ignition coil unit, said ion current detecting diode denoted in a branch line of said ion current backflow protection diode and built in said ignition coil unit.

3. An ignition apparatus for internal combustion engines having an ignition plug connection apparatus, said ignition plug connection apparatus comprising:

a conductive member mounted on a head of an ignition plug;

a plurality of diodes of which anodes are connected to said conductive member;

a frame fixing said conductive member and said diodes.

* * * * *